US011725327B2

(12) United States Patent
Maeng et al.

(10) Patent No.: US 11,725,327 B2
(45) Date of Patent: Aug. 15, 2023

(54) LAUNDRY APPLIANCES COLD WATER SANITIZATION

(71) Applicant: Haier US Appliance Solutions, Inc., Wilmington, DE (US)

(72) Inventors: Hyoyeol Maeng, Bucheon-si (KR); Kyoung-june Yi, Yongin-si (KR); Hansung Park, Bucheon-si (KR); Joohyun Park, Seongnam-si (KR); Je Kwon Yoon, Seongnam (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 156 days.

(21) Appl. No.: 17/245,226

(22) Filed: Apr. 30, 2021

(65) Prior Publication Data

US 2022/0349108 A1 Nov. 3, 2022

(51) Int. Cl.

| | |
|---|---|
| ***D06F 35/00*** | (2006.01) |
| ***D06F 39/08*** | (2006.01) |
| *D06F 103/22* | (2020.01) |
| *D06F 105/02* | (2020.01) |
| *D06F 105/54* | (2020.01) |
| *D06F 103/18* | (2020.01) |

(52) U.S. Cl.

CPC ..... *D06F 35/008* (2013.01); *D06F 35/003* (2013.01); *D06F 39/088* (2013.01); *D06F 2103/18* (2020.02); *D06F 2103/22* (2020.02); *D06F 2105/02* (2020.02); *D06F 2105/54* (2020.02)

(58) Field of Classification Search

CPC .... D06F 35/008; D06F 35/003; D06F 39/088; D06F 2103/18; D06F 2103/22; D06F 2105/02; D06F 2105/54

USPC ..... 68/13 R

See application file for complete search history.

(56) References Cited

U.S. PATENT DOCUMENTS

2008/0307667 A1* 12/2008 Ikemizu ..... D06F 58/203 34/132
2013/0152969 A1* 6/2013 Seong ..... A47L 15/0057 134/109
2017/0314179 A1* 11/2017 Arai ..... C25B 1/14

FOREIGN PATENT DOCUMENTS

KR 100470583 B1 3/2005
KR 100476295 B1 3/2005

* cited by examiner

*Primary Examiner* — Tinsae B Ayalew
(74) *Attorney, Agent, or Firm* — Dority & Manning, P.A.

(57) ABSTRACT

A laundry appliance includes a cabinet defining an opening with a laundry vessel mounted within the cabinet. The laundry vessel defines a treatment chamber. The laundry appliance also includes an electrolytic hypochlorous acid generator upstream of the treatment chamber with respect to a flow of cold water through the laundry appliance and a controller. The controller may be configured for and/or a method of sanitizing the laundry appliance may include opening a valve upstream of the electrolytic hypochlorous acid generator to provide the flow of cold water through the laundry appliance, confirming the presence of the cold water in the laundry appliance after opening the valve, and activating the electrolytic hypochlorous acid generator after confirming the presence of the cold water in the laundry appliance.

20 Claims, 7 Drawing Sheets

LAUNDRY APPLIANCES COLD WATER SANITIZATION

FIELD OF THE INVENTION

The present subject matter relates generally to laundry appliances, such as washing machine appliances and clothes dryer appliances, and in particular to such appliances with sanitization features and methods of sanitizing such appliances.

BACKGROUND OF THE INVENTION

Various laundry appliances generally include a laundry vessel therein which defines a treatment chamber for, e.g., washing and/or drying articles. For example, washing machine appliances generally include a tub for containing water or wash fluid, e.g., water and detergent, bleach, and/or other wash additives. A laundry vessel in the form of a basket is rotatably mounted within the tub and defines a wash chamber for receipt of articles for washing. During normal operation of such washing machine appliances, the wash fluid is directed into the tub and onto articles within the wash chamber of the basket. The basket can rotate at various speeds to agitate articles within the wash chamber, to wring wash fluid from articles within the wash chamber, etc.

As another example, the laundry vessel may be a drum of a clothes dryer appliance. A conventional appliance for drying articles such as a clothes dryer (or laundry dryer) for drying clothing articles typically includes a cabinet having a rotating drum for tumbling clothes and laundry articles therein. One or more heating elements heat air prior to the air entering the drum, and the warm air is circulated through the drum as the clothes are tumbled to remove moisture from laundry articles in the drum. Gas or electric heating elements may be used to heat the air that is circulated through the drum.

As yet another example, the laundry vessel may be a wash basket of a combination laundry appliance. Combination laundry appliances, sometimes also referred to as washer/dryer appliances, provide both washing and drying functions in a single unit. For example, a combination laundry appliance typically includes a wash tub and basket, similar to those described above for a washing machine appliance, in combination with one or more heating elements, such as a heat pump or any other suitable heat source, similar to those described above for a clothes dryer appliance.

Some laundry appliances include features or operations for sanitizing the appliance and/or articles within the treatment chamber thereof. Such sanitizing features and operations typically are performed as a separate and additional operation from other operations or cycles of the laundry appliance. Additionally, such sanitizing features and operations typically require the use of heated water, e.g., steam, to provide sanitization.

Accordingly, improved methods and apparatuses for sanitizing laundry appliances are desired.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of sanitizing a laundry appliance is provided. The laundry appliance includes a cabinet that defines an opening with a laundry vessel mounted within the cabinet. The laundry vessel defines a treatment chamber. The laundry appliance also includes an electrolytic hypochlorous acid generator spaced apart from the laundry vessel and upstream of the treatment chamber with respect to a flow of cold water through the laundry appliance. The electrolytic hypochlorous acid generator includes an inlet coupled to a water supply line. The flow of cold water enters the electrolytic hypochlorous acid generator at the inlet. The electrolytic hypochlorous acid generator also includes a reaction chamber defined in a body of the electrolytic hypochlorous acid generator downstream of the inlet, an electrode positioned in the reaction chamber, and an outlet downstream of the reaction chamber. The method includes opening a valve upstream of the electrolytic hypochlorous acid generator to provide the flow of cold water through the laundry appliance. The method also includes confirming the presence of the cold water in the laundry appliance after opening the valve. The method further includes activating the electrolytic hypochlorous acid generator after confirming the presence of the cold water in the laundry appliance.

In another exemplary aspect of the present disclosure, a laundry appliance is provided. The laundry appliance defines a vertical direction, a lateral direction, and a transverse direction that are mutually perpendicular to one another. The laundry appliance includes a cabinet that defines an opening with a laundry vessel mounted within the cabinet. The laundry vessel defines a treatment chamber. The laundry appliance also includes an electrolytic hypochlorous acid generator spaced apart from the laundry vessel and upstream of the treatment chamber with respect to a flow of cold water through the laundry appliance. The electrolytic hypochlorous acid generator includes an inlet coupled to a water supply line. The flow of cold water enters the electrolytic hypochlorous acid generator at the inlet. The electrolytic hypochlorous acid generator also includes a reaction chamber defined in a body of the electrolytic hypochlorous acid generator downstream of the inlet, an electrode positioned in the reaction chamber, and an outlet downstream of the reaction chamber. The laundry appliance also includes a controller. The controller is configured for opening a valve upstream of the electrolytic hypochlorous acid generator to provide the flow of cold water through the laundry appliance. The controller is also configured for confirming the presence of the cold water in the laundry appliance after opening the valve. The controller is further configured for activating the electrolytic hypochlorous acid generator after confirming the presence of the cold water in the laundry appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
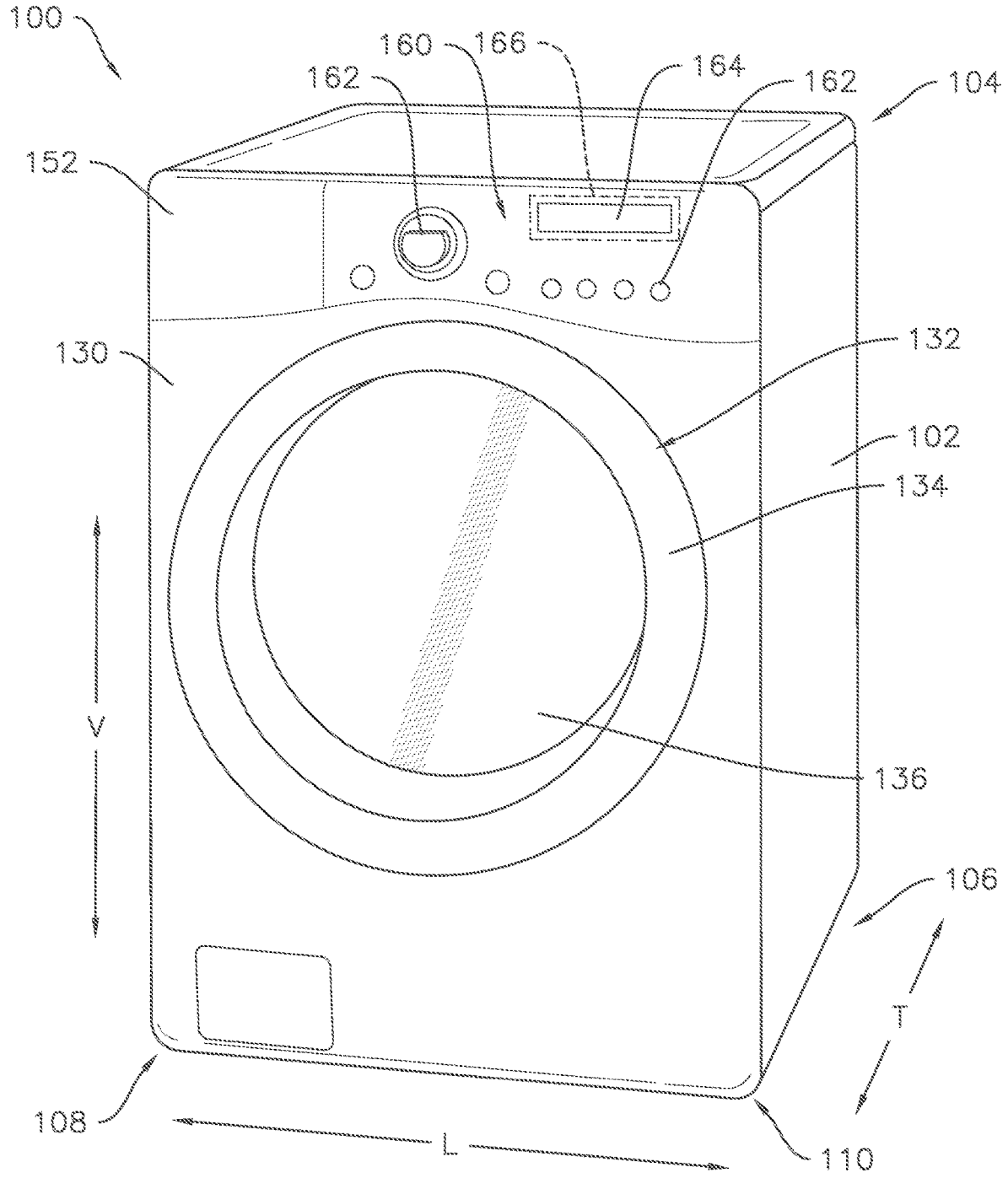
FIG. 1 provides a perspective view of a laundry appliance according to one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements.

As used herein, terms of approximation, such as "generally," or "about" include values within ten percent greater or less than the stated value, unless otherwise specified. When used in the context of an angle or direction, such terms include within ten degrees greater or less than the stated angle or direction, unless otherwise specified. For example, "generally vertical" includes directions within ten degrees of vertical in any direction, e.g., clockwise or counter-clockwise.

The present disclosure relates to laundry appliances, where "laundry appliances" is to be understood as encompassing washing machine appliances, dryer appliances, and/or combination washer-dryer appliances. As used herein, the terms "articles," "clothing," or "laundry" include but need not be limited to fabrics, textiles, garments, linens, papers, or other items which may be cleaned and/or treated in a washing machine appliance. Furthermore, the term "load" or "laundry load" refers to the combination of clothing that may be washed together in a washing machine appliance or dried together in a dryer appliance (e.g., clothes dryer) and may include a mixture of different or similar articles of clothing of different or similar types and kinds of fabrics, textiles, garments and linens within a particular laundering process.

Figure 2:
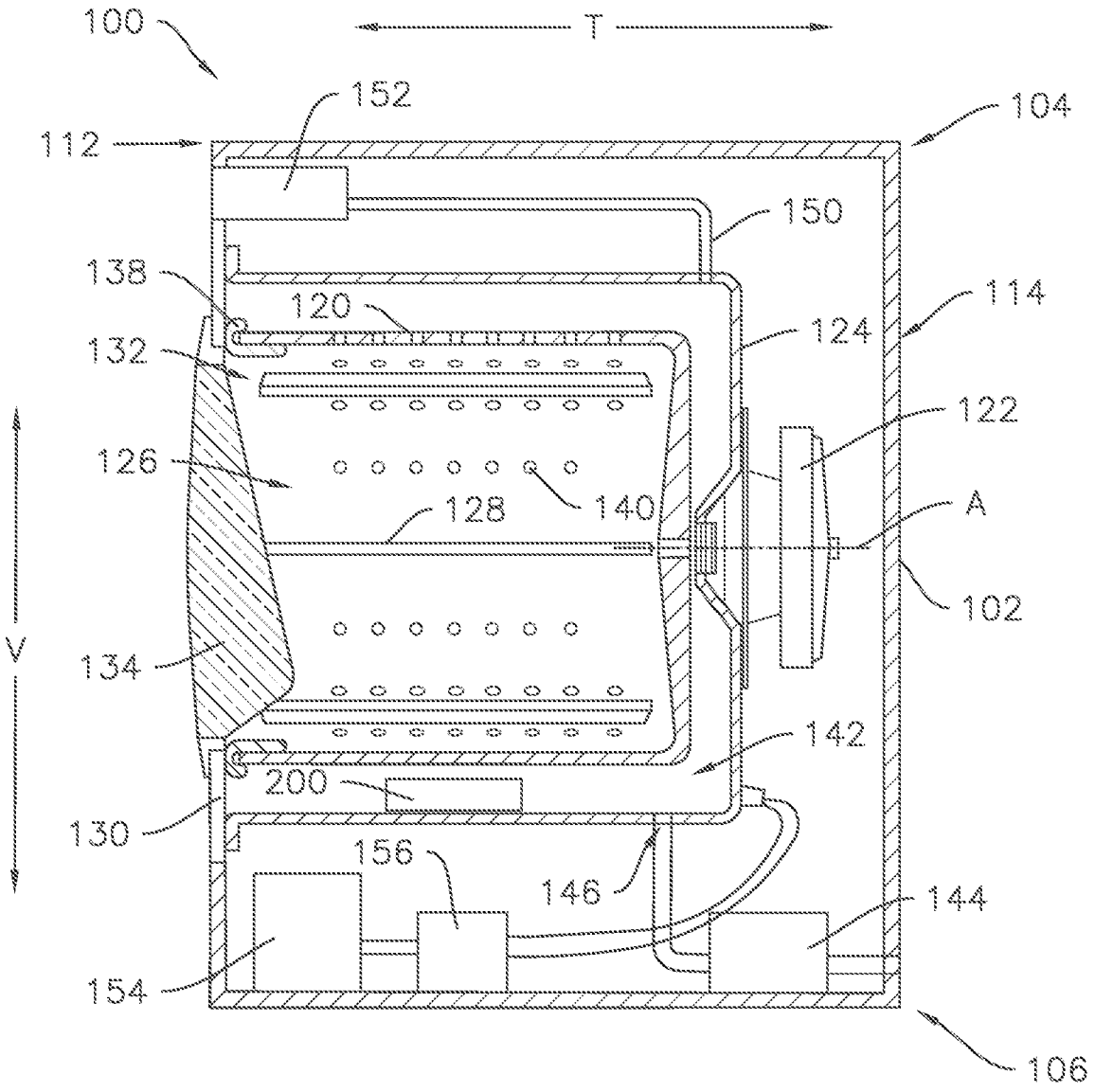
FIG. 2 provides a cross-sectional side view of the laundry appliance of FIG. 1 according to one or more exemplary embodiments of the present disclosure.
Figure 3:
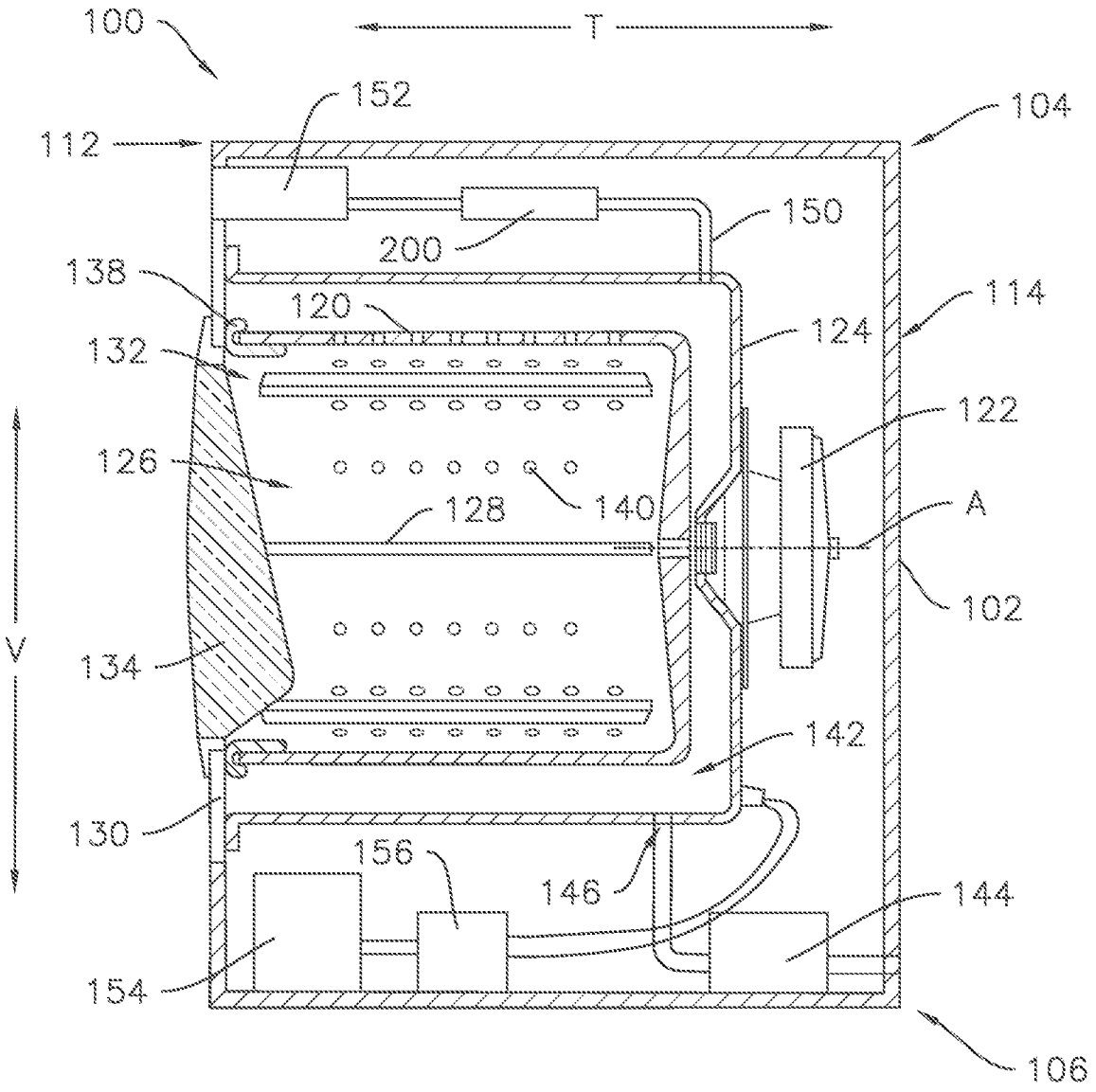
FIG. 3 provides a cross-sectional side view of the laundry appliance of FIG. 1 according to one or more additional exemplary embodiments of the present disclosure.

In some embodiments, e.g., as illustrated in FIG. 1 through 3, the laundry appliance may be a washing machine appliance. FIG. 1 is a perspective view of an exemplary horizontal axis washing machine appliance 100, FIG. 2 is a side cross-sectional view of washing machine appliance 100 according to one example embodiment, and FIG. 3 is a side cross-sectional view of washing machine appliance 100 according to another example embodiment. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

As may be seen in FIGS. 2 and 3, a wash tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Wash tub 124 is substantially fixed relative to cabinet 102 such that it does not rotate or translate relative to cabinet 102.

A wash basket 120 is received within wash tub 124 and defines a wash chamber 126 that is configured for receipt of articles for washing. More specifically, wash basket 120 is rotatably mounted within wash tub 124 such that it is rotatable about an axis of rotation A. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 120 may define one or more agitator features that extend into wash chamber 126 to assist in agitation and cleaning of articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation or a rinse cycle of washing machine appliance 100). According to the illustrated embodiment, motor assembly 122 is a pancake motor. However, it should be appreciated that any suitable type, size, or configuration of motor may be used to rotate wash basket 120 according to alternative embodiments.

Referring generally to FIGS. 1 through 3, cabinet 102 also includes a front panel 130 that defines an opening 132 that permits user access to wash basket 120 of wash tub 124. More specifically, washing machine appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a wash tub 124 and a closed position (FIG. 1) prohibiting access to wash tub 124.

In some embodiments, a window 136 in door 134 permits viewing of wash basket 120 when door 134 is in the closed position (e.g., during operation of washing machine appliance 100). Door 134 also includes a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle 138 may extend between tub 124 and the front panel 130 about the opening 132 covered by door 134, further sealing tub 124 from cabinet 102.

As illustrated for example in FIGS. 2 and 3, wash basket 120 may also include a plurality of perforations 140 extending therethrough in order to facilitate fluid communication between an interior of basket 120 and wash tub 124. A sump 142 is defined by wash tub 124 at a bottom of wash tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through the plurality of perforations 140. A pump assembly 144 is located beneath wash tub 124 for gravity assisted flow when draining wash tub 124 (e.g., via a drain 146). Pump assembly 144 is also configured for recirculating wash fluid within wash tub 124.

In some embodiments, washing machine appliance 100 includes an additive dispenser or spout 150. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated, a detergent drawer 152 may be slidably mounted within front panel 130. Detergent drawer 152 receives a wash additive (e.g., detergent, fabric softener, bleach, or any other suitable liquid or powder) and directs the fluid additive to wash chamber 126 during operation of washing machine appliance 100. According to the illustrated embodiment, detergent drawer 152 may also be fluidly coupled to spout 150 to facilitate the complete and accurate dispensing of wash additive.

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of washing machine appliance 100 is controlled by a controller or processing device 166 that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122, may be in communication with controller 166 via one or more signal lines or shared communication busses. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In exemplary embodiments, during operation of washing machine appliance 100, laundry items are loaded into wash basket 120 through opening 132, and a wash operation is initiated through operator manipulation of input selectors 162. For example, a wash cycle may be initiated such that wash tub 124 is filled with water, detergent, or other fluid additives (e.g., via spout 150). One or more valves (not shown) can be controlled by washing machine appliance 100 to provide for filling wash basket 120 to the appropriate level for the amount of articles being washed or rinsed. By way of example, once wash basket 120 is properly filled with fluid, the contents of wash basket 120 can be agitated (e.g., with ribs 128) for an agitation phase of laundry items in wash basket 120. During the agitation phase, the basket 120 may be motivated about the axis of rotation A at a set speed (e.g., a tumble speed). As the basket 120 is rotated, articles within the basket 120 may be lifted and permitted to drop therein.

After the agitation phase of the washing operation is completed, wash tub 124 can be drained. Laundry articles can then be rinsed (e.g., through a rinse cycle) by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle or after the rinse cycle in order to wring wash fluid from the articles being washed. During a spin cycle, basket 120 is rotated at relatively high speeds. For instance, basket 120 may be rotated at one set speed (e.g., a pre-plaster speed) before being rotated at another set speed (e.g., a plaster speed). As would be understood, the pre-plaster speed may be greater than the tumble speed and the plaster speed may be greater than the pre-plaster speed. Moreover, agitation or tumbling of articles may be reduced as basket 120 increases its rotational velocity such that the plaster speed maintains the articles at a generally fixed position relative to basket 120.

After articles disposed in wash basket 120 are cleaned (or the washing operation otherwise ends), a user can remove the articles from wash basket 120 (e.g., by opening door 134 and reaching into wash basket 120 through opening 132).

Figure 4:
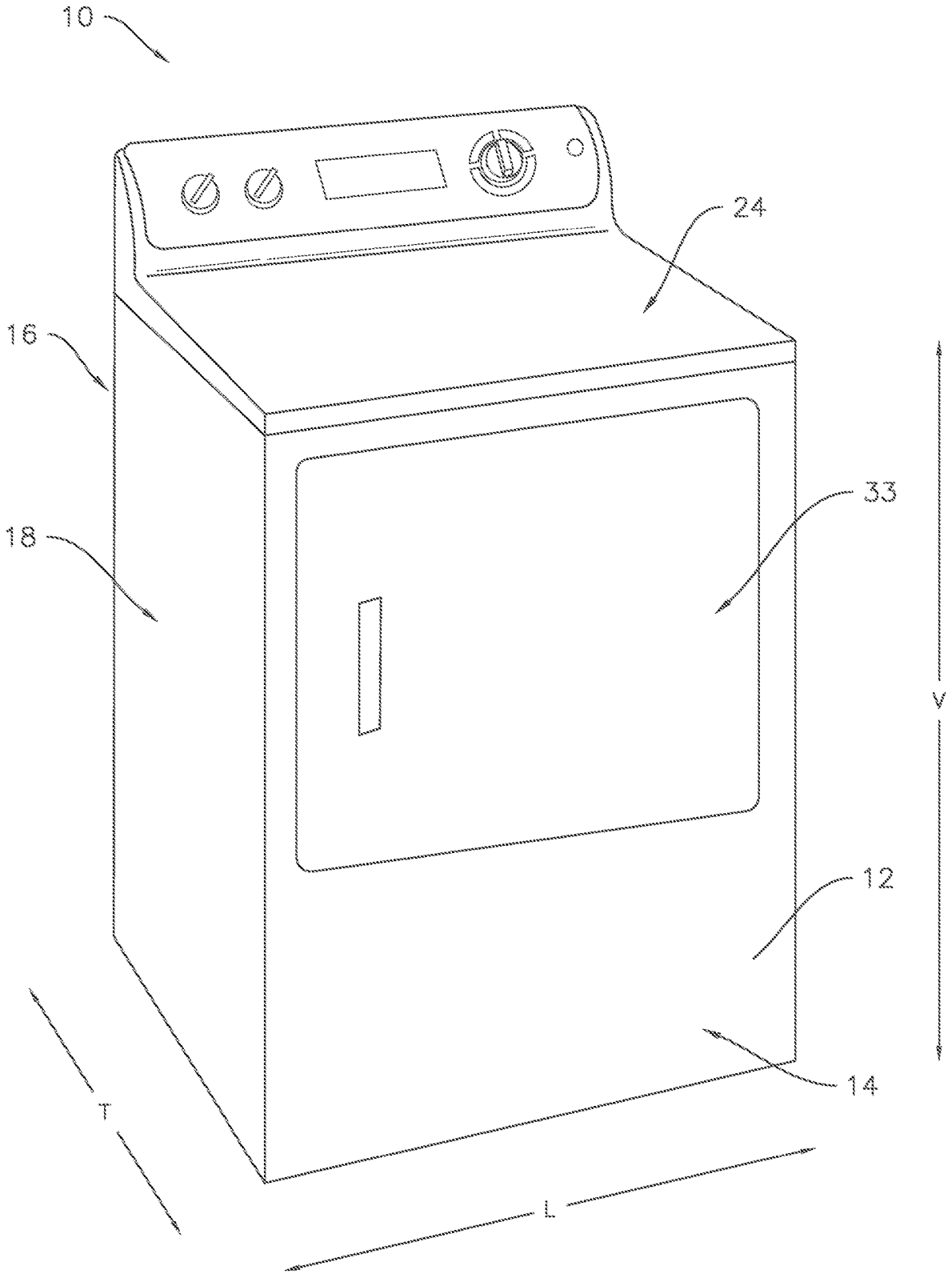
FIG. 4 provides a perspective view of another laundry appliance in accordance with one or more further exemplary embodiments of the present disclosure.
Figure 5:
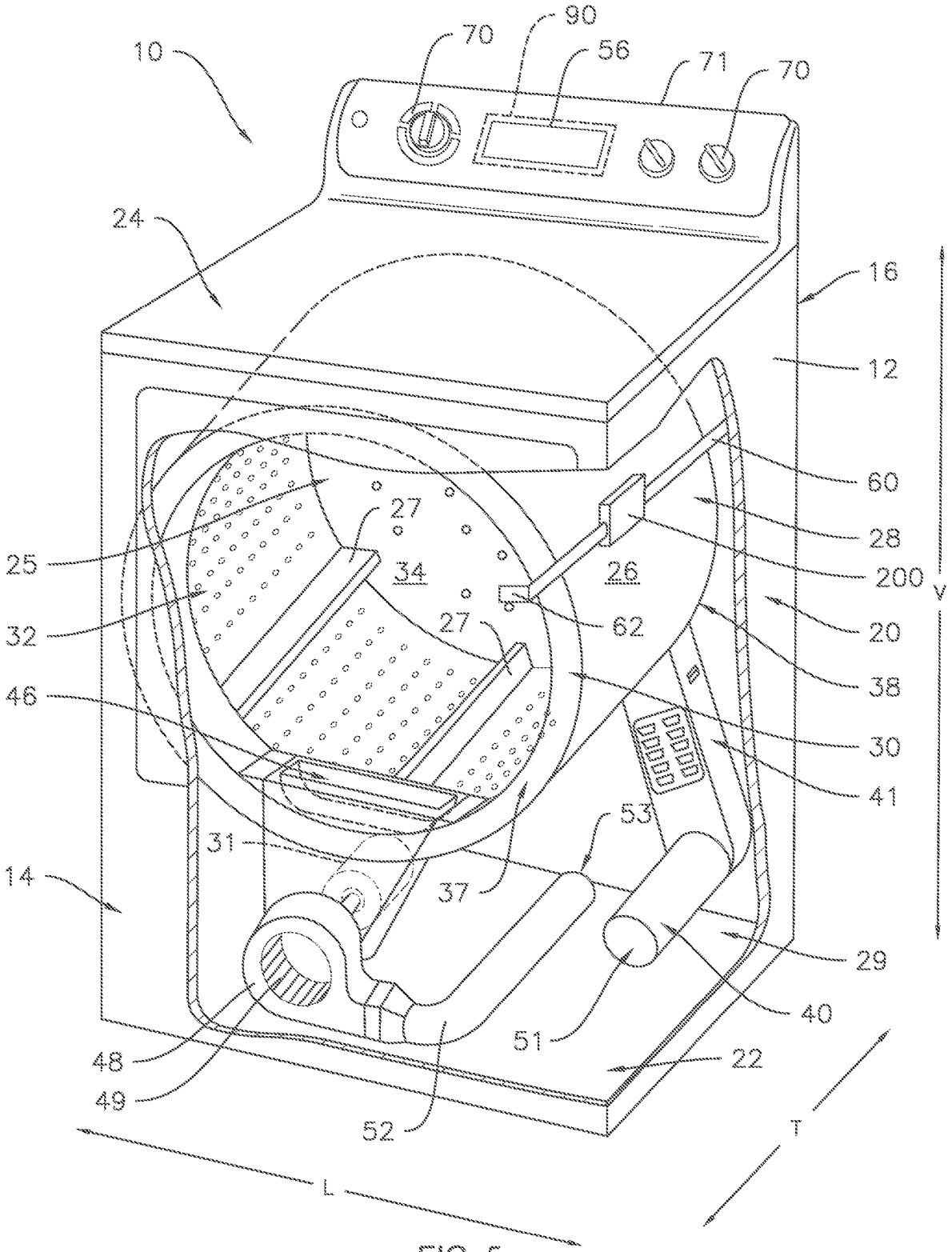
FIG. 5 provides a perspective view of the example laundry appliance of FIG. 4 with portions of a cabinet of the laundry appliance removed to reveal certain components of the dryer appliance.

Referring now to FIGS. 4 and 5, in some embodiments, the laundry appliance may be a dryer appliance. For example, FIG. 4 provides a perspective view of dryer appliance 10 according to one or more exemplary embodiments of the present disclosure. FIG. 5 provides another perspective view of dryer appliance 10 with a portion of a cabinet or housing 12 of dryer appliance 10 removed in order to show certain components of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Drum 26 includes a rear wall 34 rotatably supported within main housing 12 by a suitable fixed bearing. Rear wall 34 can be fixed or can be rotatable. Rear wall 34 may include, for instance, a plurality of holes that receive hot air that has been heated by a heating assembly or system 40, as will be described further below. Motor 31 is also in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein. In alternative example embodiments, dryer appliance 10 may include an additional motor (not shown) for rotating fan 49 of air handler 48 independently of drum 26.

Drum 26 is configured to receive heated air that has been heated by a heating assembly 40, e.g., via holes in the rear wall 34 as mentioned above, in order to dry damp articles disposed within chamber 25 of drum 26. For example, heating assembly 40 may include any suitable heat source, such as a gas burner, an electrical resistance heating element, or heat pump, for heating air. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an inlet 51 due to air handler 48 urging such ambient air into inlet 51. Such ambient air is heated within heating assembly 40 and exits heating assembly 40 as heated air. Air handler 48 draws such heated air through supply duct 41 to drum 26. The heated air enters drum 26 through a plurality of outlets of supply duct 41 positioned at rear wall 34 of drum 26.

Within chamber 25, the heated air may accumulate moisture, e.g., from damp clothing disposed within chamber 25. In turn, air handler 48 draws moisture-saturated air through a screen filter (not shown) which traps lint particles. Such moisture-statured air then enters an exit duct 46 and is passed through air handler 48 to an exhaust duct 52. From exhaust duct 52, such moisture-statured air passes out of dryer appliance 10 through a vent 53 defined by cabinet 12. After the clothing articles have been dried, they are removed from the drum 26 via opening 32. A door 33 (FIG. 4) provides for closing or accessing drum 26 through opening 32. The door 33 may be movable between an open position and a closed position, the open position for access to the chamber 25 defined in the drum 26, and the closed position for sealingly enclosing the chamber 25 defined in the drum 26.

As illustrated in FIG. 5, in some embodiments, the dryer appliance 10 may include a spray nozzle 62 positioned and configured to direct a mist of water into the chamber 25 of the drum 26. The spray nozzle 62 may be coupled to and in fluid communication with a water line 60 which provides a flow of water for forming the mist to be sprayed from the spray nozzle 62 into the chamber 25.

In some embodiments, one or more selector inputs 70, such as knobs, buttons, touchscreen interfaces, etc., may be provided or mounted on a cabinet 12 (e.g., on a backsplash 71 of the cabinet 12) and are in operable communication (e.g., electrically coupled or coupled through a wireless network band) with a processing device or controller 90. A display 56 may also be provided on the backsplash 71 and may also be in operable communication with the controller 90. Controller 90 may also be provided in operable communication with motor 31, air handler 48, and/or heating assembly 40. In turn, signals generated in controller 90 direct operation of motor 31, air handler 48, and/or heating assembly 40 in response to the position of inputs 70. In the example illustrated in FIG. 5, the inputs 70 are provided as knobs. In other embodiments, inputs 70 may also or instead include buttons, switches, touchpads and/or a touch screen type interface.

Controller 90 is a "processing device" or "controller" and may be embodied as described herein. As used herein, "processing device" or "controller" may refer to one or more microprocessors, microcontrollers, application-specific integrated circuits (ASICS), or semiconductor devices and is not restricted necessarily to a single element. The controller 90 may be programmed to operate dryer appliance 10 by executing instructions stored in memory (e.g., non-transitory media). The controller 90 may include, or be associated with, one or more memory elements such as RAM, ROM, or electrically erasable, programmable read only memory (EEPROM). For example, the instructions may be software or any set of instructions that when executed by the processing device, cause the processing device to perform operations. Controller 90 may include one or more processor(s) and associated memory device(s) configured to perform a variety of computer-implemented functions and/or instructions (e.g. performing the methods, steps, calculations and the like and storing relevant data as disclosed herein). It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In various embodiments, the laundry appliance may include a sanitization device 200, such as a hypochlorous acid (HOCl) generator. Those of ordinary skill in the art will recognize that the HOCl generator 200 may be an electrolytic HOCl generator which catalyzes a reaction with chlorine in the water to produce the HOCl. As may be seen, e.g., in FIGS. 2, 3, and 5, the HOCl generator 200 may, in various embodiments, be physically separate from, e.g., not integrally joined to or unitary with, the laundry vessel, e.g., the basket 120 in washing machine embodiments or the drum 26 in dryer embodiments. Also, the HOCl generator 200 may, in various embodiments, be physically separate from, e.g., not integrally joined to or unitary with, the tub 124 in at least some washing machine embodiments, such as the illustrated exemplary embodiments of FIGS. 2 and 3. In some embodiments, e.g., where the laundry appliance is a washing machine appliance, the HOCl generator 200 may be located in the sump 142 of the washing machine appliance, such as in the example embodiment illustrated in FIG. 2. In other embodiments, where the laundry appliance includes a water supply line, such as the spout 150 in the example embodiments illustrated in FIGS. 2 and 3, or the water line 60 in the exemplary dryer appliance illustrated in FIG. 5, the sanitization device, e.g., HOCl generator, 200 may be provided in-line with the water line, e.g., in-line with spout 150 as illustrated in FIG. 3 or in-line with water line 60 as illustrated in FIG. 5. Thus, the HOCl generator 200 may include an inlet 208, as will be described in more detail below with respect to FIGS. 6 and 7, and the inlet 208 may be coupled to a water supply line. For example, the inlet 208 may be directly coupled to the water supply line in embodiments such as the exemplary embodiments illustrated in FIGS. 3 and/or 5, or may be in indirect fluid communication with the water supply line, e.g., as illustrated in FIG. 2.

In various embodiments, the HOCl generator 200 is positioned upstream of the treatment chamber with respect to a flow of water, e.g., cold water, through the laundry appliance, where the treatment chamber may be, e.g., the wash chamber 126 in embodiments where the laundry appliances is a washing machine appliance or chamber 25 of dryer appliance 10 in embodiments where the laundry appliance is a dryer appliance. The flow of water through the laundry appliance may be regulated by a valve (not shown), sometimes referred to as a supply valve and, in at least some embodiments a cold water supply valve, such that the controller, e.g., controller 90 or controller 166, of the laundry appliance may be configured for and/or a method of operating the laundry appliance may include opening the valve to provide the flow of water, e.g., cold water, through the laundry appliance. Thus, the valve is upstream of other components of the laundry appliance, in particular the HOCl generator 200 and the treatment chamber 126 or 25. The structure and function of such valves are understood by those of ordinary skill in the art and, as such, are not shown or described in further detail herein for the sake of brevity and clarity.

As mentioned, the water which flows through the laundry appliance may be or include cold water. Cold water may include water having a temperature based on the water source(s) from which the water is obtained. Further, "cold" water as used herein to include a wide range of temperatures that are not hot. For example, cold water, as used herein, may be between approximately 35 degrees Fahrenheit and approximately 120 degrees Fahrenheit, such as between approximately 40 degrees Fahrenheit and approximately 110 degrees Fahrenheit, such as between approximately 45 degrees Fahrenheit and approximately 100 degrees Fahrenheit, such as between approximately 55 degrees Fahrenheit and approximately 90 degrees Fahrenheit, such as between approximately 65 degrees Fahrenheit and approximately 80 degrees Fahrenheit, such as between approximately 40 degrees Fahrenheit and approximately 60 degrees Fahrenheit, such as approximately 50 degrees Fahrenheit, or approximately 80 degrees Fahrenheit, or approximately 110 degrees Fahrenheit.

Thus, when the HOCl generator 200 is activated, e.g., by supplying electric power thereto such as in embodiments where the HOCl generator 200 is an electrolytic HOCl generator, the liquid flowing to the treatment chamber 25 or 126 (which is downstream of the HOCl generator 200) will include hypochlorous acid (HOCl), such as a solution of water and HOCl. Further, it should be understood that the liquid, e.g., "water," may also include additional constituents, e.g., minerals, laundry treatment chemicals such as detergents, perfumes, etc., and other substances.

Figure 6:
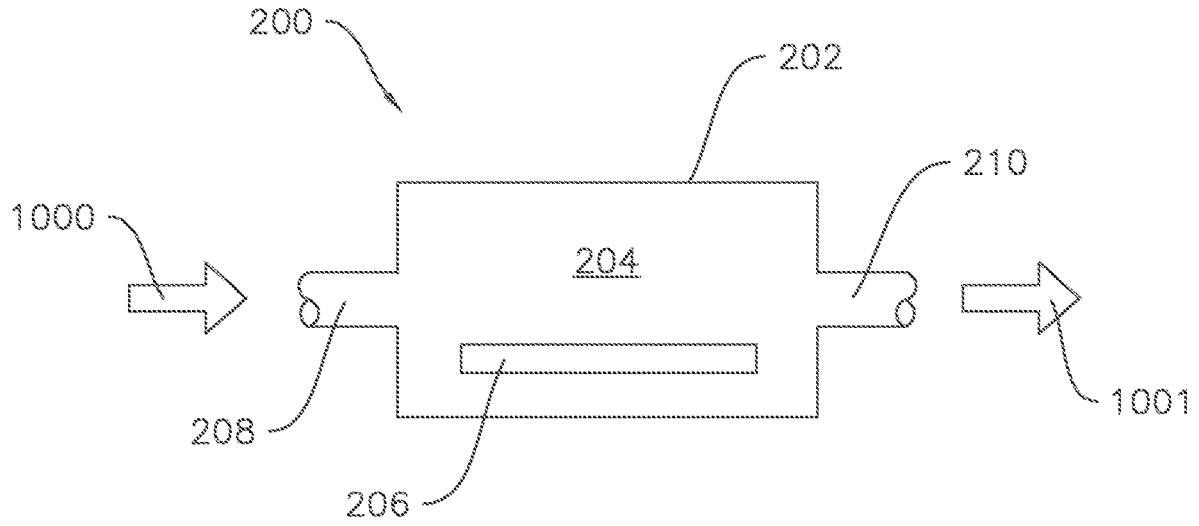
FIG. 6 provides a schematic view of an electrolytic hypochlorous acid generator according to one or more embodiments of the present disclosure.
Figure 7:
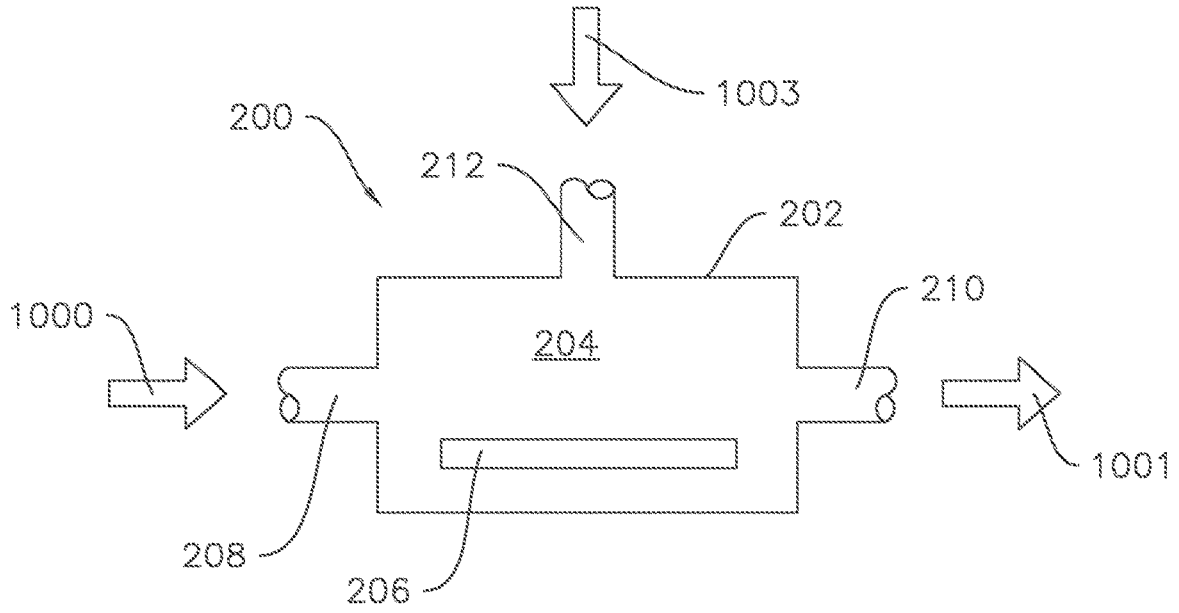
FIG. 7 provides a schematic view of an electrolytic hypochlorous acid generator according to one or more additional embodiments of the present disclosure.

FIG. 6 provides a schematic view of an electrolytic HOCl generator 200 according to one or more embodiments of the present disclosure and FIG. 7 provides a schematic view of the electrolytic HOCl generator 200 according to one or more alternative embodiments of the present disclosure. In particular, some embodiments, e.g., the exemplary embodiment illustrated in FIG. 6, of the electrolytic HOCl generator 200 include only a single inlet 208 and no other points of ingress or inflow into the reaction chamber 204, whereas alternative embodiments, e.g., as illustrated in FIG. 7, include a second inlet 212. The inlet 208 may be coupled to and/or in fluid communication with a water supply line, whereby the inlet 208 receives a flow of cold water from the water supply line, e.g., directly from the water supply line (FIGS. 3 and 5). Thus, in embodiments where the inlet 208 is the only inlet into the reaction chamber 204, the electrolytic HOCl generator 200 uses chlorine which is already present in the cold water, e.g., a background or baseline chlorine concentration such as residual chlorine from a water treatment system upstream of the laundry appliance 100 or 10, to generate the HOCl. In embodiments which include an additional inlet, e.g., inlet 212, the electrolytic HOCl generator 200 may receive an additive including a reactant, e.g., chlorine, which is then used to create additional HOCl, e.g., an output 1001 from the electrolytic HOCl generator 200 comprising a higher concentration of HOCl as compared to embodiments with only the single inlet 208 that use only the baseline chlorine in the cold water to generate HOCl.

As generally seen in FIGS. 6 and 7, in various embodiments, the HOCl generator 200 may include a body 202 and a reaction chamber 204 defined in and by the body 202. An electrode 206 may be positioned in the reaction chamber 204 within the body 202. As mentioned, an inlet 208 may be formed in or directly connected to the body 202 and the inlet 208 may be coupled to a water supply line whereby the flow of cold water 1000 enters the electrolytic hypochlorous acid generator 200 from the water supply line at the inlet 208. Thus, as those of ordinary skill in the art will understand, the electrode 206 may be activated, e.g., by providing a current thereto, and when so activated, the electrode 206 initiates or catalyzes a reaction among constituent elements in the flow of cold water, including solutes and other substances therein, such as chlorine, to form or generate HOCl within the reaction chamber 204. The HOCl generator 200 may further include an outlet 210 downstream of the reaction chamber 204 such that an output flow 1001 including water and HOCl generated in the reaction chamber 204 flows from (out of) the electrolytic HOCl generator 200 by and/or from the outlet 210.

As discussed above, in some embodiments, the inlet 208 of the electrolytic hypochlorous acid generator 200 that is coupled to the water supply line is the only inlet into the reaction chamber 204 of the electrolytic hypochlorous acid generator 200, whereby the reaction which produces the HOCl in the reaction chamber 204 consumes only background chlorine already present in the cold water 1000. In alternative embodiments, e.g., as illustrated in FIG. 7, the electrolytic HOCl generator 200 may receive an additive, e.g., a reactant, 1003 from a reactant supply (e.g., a reservoir, which is not specifically illustrated or described in further detail because the structure and function of reservoirs would be understood by those of ordinary skill in the art) into the reaction chamber 204 which reacts with the cold water and/or adjusts the conditions, such as pH, within the reaction chamber 204 when the electrode 206 is activated, thereby resulting in a higher concentration of HOCl, e.g., a higher parts per million (ppm) of HOCl, in the output 1001 in embodiments with multiple inlets into the reaction chamber 204 within the body 202 of the electrolytic HOCl generator 200. For example, the additive may be a compound including table salt, e.g., sodium chloride or NaCl, water ($H_2O$), and a mild acid such as vinegar, e.g., acetic acid or $CH_3COOH$. The pH of the solution (e.g., tap water and additive mixed together) within the reaction chamber 204 correlates to the product of the reaction when the electrode 206 is activated, and the additive may help provide a pH which is high enough to avoid generating chlorine gas ($Cl_2$) and low enough to avoid producing bleach, e.g., sodium hypochlorite (NaOCl or NaClO) and/or hypochlorite ions ($OCl^-$ or $ClO^-$), whereby HOCl is generated preferentially to chlorine gas or bleach when the reaction occurs at the desired pH, such as generating at least about 90% HOCl. For example, the desired pH may be generally in a range that those of ordinary skill in the art will recognize as being weakly acidic, such as between about 3.0 and about 6.5, such as between about 4.0 and about 5.5. For example, a pH of about 3.0 may result in a production of about 10% $Cl_2$ and about 90% HOCl, whereas a pH of about 6.5 may result in a production of about 10% bleach (hypochlorite ions and/or hypochlorite salt such as sodium hypochlorite) and about 90% HOCl, and pH values between 3.0 and 6.5 may generate at least about 90% HOCl. In particular, a pH of the solution between about 4.0 and about 5.5 may generate about 97% HOCl or higher, such as about 99% HOCl, such as about 100% HOCl (where the stated percentages are relative to other chlorine species, e.g., chlorine gas or bleach, as discussed herein).

Embodiments which include an additional inlet 212 for receiving additive may advantageously provide stronger disinfection due to the higher ppm of HOCl in the output 1001. However, such embodiments may also be more sensitive to the pH of the solution. For example, the higher levels of chlorine provided by the additive may result in generation of undesirable quantities of chlorine gas if the solution is too acidic (pH is too low) or hypochlorite ions if the solution is too basic (pH too high) instead of the desired HOCl. Embodiments which include only the single inlet coupled to the water supply line advantageously provide a simpler structure, not only of the HOCl generator 200 itself, but of the sanitization system overall, e.g., in that the additive reservoir and associated pump or injection system is not required or included in such embodiments. Further, in the single-inlet embodiments although the proportion of chlorine present in the tap water (the flow of cold water) 1000 is relatively low, e.g., as compared to the level of chlorine in the additive 1003 in other embodiments which include the second inlet 212, the relatively large volume of the water 1000 (again, as compared to the volume of additive 1003) generally provides sufficient total chlorine for sanitizing the laundry appliance.

Figure 8:
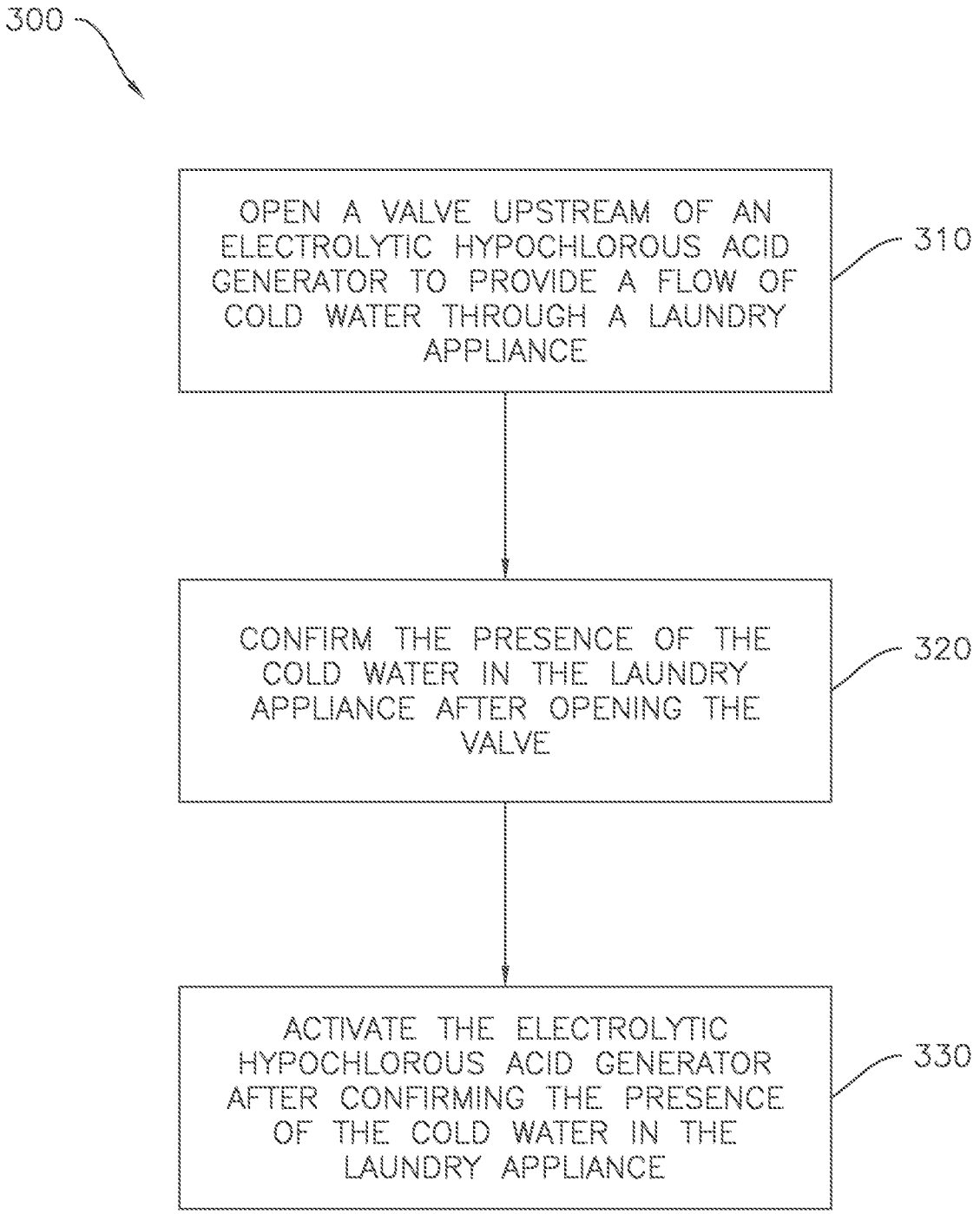
FIG. 8 provides a flow chart illustrating a method for operating a laundry appliance in accordance with one or more additional exemplary embodiments of the present disclosure.

Referring now to FIG. 8, embodiments of the present disclosure include methods of sanitizing a laundry appliance, for example, one of the laundry appliances illustrated in FIGS. 1-3 or in FIGS. 4 and 5. As illustrated in FIG. 8, a method 300 of sanitizing a laundry appliance may include a step 310 of opening a valve, e.g., a cold water supply valve, upstream of an electrolytic hypochlorous acid generator, and opening the valve may thereby provide a flow of, e.g., cold, water through the laundry appliance. For example, in embodiments where the laundry appliance is a washing machine appliance, the flow of water may flow from the spout into the tub, such as into the sump of the tub, and from the tub into the basket, such as through the perforations in the basket, as described above. As another example, in embodiments where the laundry appliance is a dryer appliance, opening the valve may include and/or result in spraying the cold water into the treatment chamber from the spray nozzle when the valve is opened.

The method 300 may then include confirming the presence of the cold water in the laundry appliance after opening the valve, e.g., as illustrated at 320 in FIG. 8. For example, in embodiments where the laundry appliance is a washing machine appliance with a sump, e.g., sump 142 as described above, the electrolytic hypochlorous acid (HOCl) generator 200 may be positioned in the sump, the step 320 of confirming the presence of the cold water in the laundry appliance may include confirming that a pressure in the sump is above a pressure threshold with a pressure sensor. The structure and function of pressure sensors are understood by those of ordinary skill in the art and, as such, are not shown or described in further detail herein for the sake of brevity and clarity. In additional embodiments, where the laundry appliance includes a water line, such as spout 150 or water line 60 as described above, and the electrolytic hypochlorous acid generator is fluidly coupled to (in line with) the water line, the step 320 of confirming the presence of the cold water in the laundry appliance may include checking for water level codes in a memory of a controller of the laundry appliance. For example, the controller, e.g., 90 or 166, may be operable to monitor for critical faults during operation of the laundry appliance and to store codes corresponding to such faults in the memory of the controller. Such critical fault codes may include faults which indicate the flow of water is not being provided as anticipated, such as the supply valve may be stuck or the water source may be inoperable, etc. In such embodiments, the absence of a water supply fault code in the memory of the controller may generally indicate the water is flowing into and through the laundry appliance as intended.

Also as illustrated in FIG. 8, the method 300 may further include a step 330 of activating the electrolytic hypochlorous acid generator after confirming the presence of the cold water in the laundry appliance. In some embodiments where the laundry appliance is a washing machine appliance with a detergent drawer coupled to the spout upstream of the tub, the step 330 of activating the electrolytic hypochlorous acid generator may be performed when the detergent drawer is empty. For example, the step 330 (and the entire method 300) may be performed after a wash cycle which includes flowing water into and through the detergent drawer, whereby the detergent drawer is "empty" at least in that any detergent or other additives therein, if any, would have been flushed out during the wash cycle.

As will be recognized by those of ordinary skill in the art, the laundry appliance, e.g., washing machine appliance, may be configured to perform a variety of operations or cycles, such as a wash operation comprising a wash stage, a drain stage, and a rinse stage, etc., or a self-clean cycle. In various embodiments, the laundry appliance may be configured for performing the sanitizing method, e.g., method 300, during a preexisting operation or cycle (e.g., as opposed to a stand-alone operation or cycle) and/or the method of sanitizing the laundry appliance may be incorporated into a preexisting method of, e.g., washing and/or drying articles in the laundry appliance, also, for example, in contrast to as a stand-alone method. In such embodiments, the sanitizing operation or method may advantageously be incorporated into the existing fill of the, e.g., wash operation or self-clean cycle, without increasing the overall time or water consumed during the preexisting operation or method. For example, the step 310 of opening the valve upstream of the electrolytic hypochlorous acid generator to provide the flow of cold water through the laundry appliance may be providing all or a portion of a cold water fill for a self-clean cycle of the appliance, and the volume of water used in the cold water fill of the self-clean cycle may, in such embodiments, be the same as a volume of water used in a cold water fill of a self-clean cycle in the same appliance that does not include the method of sanitizing the laundry appliance. As another example, the step 310 of opening the valve upstream of the electrolytic hypochlorous acid generator to provide the flow of cold water through the washing machine appliance may be providing all or a portion of a cold water fill for a rinse cycle of the washing machine appliance, and the volume of water used in the cold water fill of the rinse cycle is the same as a volume of water used in a cold water fill of a rinse cycle in the same appliance that does not include the method of sanitizing the washing machine appliance. As mentioned above, the rinse cycle may be a rinse stage of a wash operation in a washing machine appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of sanitizing a laundry appliance, the laundry appliance including a cabinet defining an opening, a laundry vessel mounted within the cabinet, the laundry vessel defining a treatment chamber, and an electrolytic hypochlorous acid generator spaced apart from the laundry vessel and upstream of the treatment chamber with respect to a flow of cold water through the laundry appliance, the electrolytic hypochlorous acid generator comprising an inlet coupled to a water supply line, whereby the flow of cold water enters the electrolytic hypochlorous acid generator at the inlet, a reaction chamber defined in a body of the electrolytic hypochlorous acid generator downstream of the inlet, an electrode positioned in the reaction chamber, and an outlet downstream of the reaction chamber, the method comprising:

opening a valve upstream of the electrolytic hypochlorous acid generator to provide the flow of cold water through the laundry appliance, thereby providing a cold water fill for a self-clean cycle of the laundry appliance, and wherein the volume of water used in the cold water fill of the self-clean cycle is the same as a volume of water used in a cold water fill of a self-clean cycle that does not include the method of sanitizing the laundry appliance;

confirming the cold water is present in the laundry appliance after opening the valve; and activating the electrolytic hypochlorous acid generator after confirming the cold water is present in the laundry appliance.

2. The method of claim 1, wherein the laundry appliance is a washing machine appliance, the laundry vessel is a wash basket positioned within a wash tub of the washing machine appliance, the washing machine appliance further comprising a sump defined by the tub outside of the wash basket, the electrolytic hypochlorous acid generator positioned in the sump, wherein the step of confirming the presence of the cold water in the laundry appliance comprises confirming that a pressure in the sump is above a pressure threshold with a pressure sensor.

3. The method of claim 1, wherein the step of confirming the presence of the cold water in the laundry appliance comprises checking for water level codes in a memory of a controller of the laundry appliance.

4. The method of claim 3, wherein the laundry appliance is a dryer appliance and the water supply line is fluidly coupled to a spray nozzle positioned and configured to direct the flow of cold water through the dryer appliance into the treatment chamber in the form of a mist of cold water, the method further comprising spraying the cold water into the treatment chamber from the spray nozzle when the valve upstream of the electrolytic hypochlorous acid generator is opened.

5. The method of claim 3, wherein the laundry appliance is a washing machine appliance and the water supply line is a spout coupled to a detergent drawer, wherein the step of activating the electrolytic hypochlorous acid generator is performed when the detergent drawer is empty.

6. A washing machine appliance defining a vertical direction, a lateral direction, and a transverse direction that are mutually perpendicular to one another, the washing machine appliance comprising:

a cabinet defining an opening;

a wash tub mounted within the cabinet;

a wash basket positioned within the wash tub, the wash basket defining a treatment chamber;

an electrolytic hypochlorous acid generator spaced apart from the laundry vessel and upstream of the treatment chamber with respect to a flow of cold water through the washing machine appliance, the electrolytic hypochlorous acid generator comprising an inlet coupled to a water supply line, whereby the flow of cold water enters the electrolytic hypochlorous acid generator at the inlet, a reaction chamber defined in a body of the electrolytic hypochlorous acid generator downstream of the inlet, an electrode positioned in the reaction chamber, and an outlet downstream of the reaction chamber;

a sump defined by the wash tub outside of the wash basket, the electrolytic hypochlorous acid generator positioned in the sump; and a controller, the controller configured for:

opening a valve upstream of the electrolytic hypochlorous acid generator to provide the flow of cold water through the washing machine appliance;

confirming the presence of the cold water in the washing machine appliance after opening the valve; and activating the electrolytic hypochlorous acid generator after confirming the presence of the cold water in the washing machine appliance.

7. The washing machine appliance of claim 6, further comprising a pressure sensor positioned and configured to measure a liquid pressure within the sump, wherein the controller is configured for confirming the presence of the cold water in the washing machine appliance by confirming that a pressure in the sump is above a pressure threshold with the pressure sensor.

8. The washing machine appliance of claim 6, wherein the controller is configured for confirming the presence of the cold water in the washing machine appliance by checking for water level codes in a memory of the controller.

9. The washing machine appliance of claim 6, wherein the the water supply line is fluidly coupled to a spray nozzle positioned and configured to direct the flow of cold water through the washing machine appliance into the treatment chamber in the form of a mist of cold water.

10. The washing machine appliance of claim 9, wherein opening the valve upstream of the electrolytic hypochlorous acid generator to provide the flow of cold water through the washing machine appliance comprises spraying the cold water into the treatment chamber from the spray nozzle in the form of the mist of cold water.

11. The washing machine appliance of claim 6, wherein the water supply line is a spout coupled to a detergent drawer.

12. The washing machine appliance of claim 11, wherein the controller is configured for activating the electrolytic hypochlorous acid generator when the detergent drawer is empty.

13. The washing machine appliance of claim 6, wherein opening the valve upstream of the electrolytic hypochlorous acid generator to provide the flow of cold water through the washing machine appliance comprises providing a cold water fill for a self-clean cycle of the washing machine appliance, and wherein the volume of water used in the cold water fill of the self-clean cycle is the same as a volume of water used in a cold water fill of a self-clean cycle that does not include sanitizing the washing machine appliance.

14. The washing machine appliance of claim 6, wherein opening the valve upstream of the electrolytic hypochlorous acid generator to provide the flow of cold water through the washing machine appliance comprises providing a cold water fill for a rinse cycle of the washing machine appliance, and wherein the volume of water used in the cold water fill of the rinse cycle is the same as a volume of water used in a cold water fill of a rinse cycle that does not include sanitizing the washing machine appliance.

15. The washing machine appliance of claim 6, wherein the inlet of the electrolytic hypochlorous acid generator coupled to the water supply line is the only inlet into the reaction chamber of the electrolytic hypochlorous acid generator.

16. The washing machine appliance of claim 6, wherein the electrolytic hypochlorous acid generator further comprises an additive inlet coupled to a reactant supply, whereby the flow of cold water from the water supply line mixes with a reactant from the reactant supply within the reaction chamber.

17. A washing machine appliance defining a vertical direction, a lateral direction, and a transverse direction that are mutually perpendicular to one another, the washing machine appliance comprising:

a cabinet defining an opening;

a laundry vessel mounted within the cabinet, the laundry vessel defining a treatment chamber;

a detergent drawer;

a spout coupled to a detergent drawer;

an electrolytic hypochlorous acid generator spaced apart from the laundry vessel and upstream of the treatment chamber with respect to a flow of cold water through the washing machine appliance, the electrolytic hypochlorous acid generator comprising an inlet coupled to the spout, whereby the flow of cold water enters the electrolytic hypochlorous acid generator at the inlet, a reaction chamber defined in a body of the electrolytic hypochlorous acid generator downstream of the inlet, an electrode positioned in the reaction chamber, and an outlet downstream of the reaction chamber; and a controller, the controller configured for:

opening a valve upstream of the electrolytic hypochlorous acid generator to provide the flow of cold water through the washing machine appliance;

confirming the presence of the cold water in the washing machine appliance after opening the valve; and activating the electrolytic hypochlorous acid generator after confirming the presence of the cold water in the washing machine appliance.

18. The washing machine appliance of claim 17, wherein the controller is configured for activating the electrolytic hypochlorous acid generator when the detergent drawer is empty.

19. The washing machine appliance of claim 17, further comprising a sump defined by the tub outside of the wash basket, wherein the electrolytic hypochlorous acid generator is positioned in the sump.

20. The washing machine appliance of claim 17, wherein opening the valve upstream of the electrolytic hypochlorous acid generator to provide the flow of cold water through the washing machine appliance comprises providing a cold water fill for a rinse cycle of the washing machine appliance, and wherein the volume of water used in the cold water fill of the rinse cycle is the same as a volume of water used in a cold water fill of a rinse cycle that does not include sanitizing the washing machine appliance.

* * * * *